US008448891B2

(12) United States Patent
Bruynoghe et al.

(10) Patent No.: US 8,448,891 B2
(45) Date of Patent: May 28, 2013

(54) YARN STORAGE DEVICE

(75) Inventors: Koen Bruynoghe, De Pinte (BE); Peter Garnett, Morpeth (GB)

(73) Assignee: NV Michael Van de Wiele (BE)

( * ) Notice: Subject to any disclaimer, the term of this patent is extended or adjusted under 35 U.S.C. 154(b) by 351 days.

(21) Appl. No.: 12/936,265

(22) PCT Filed: Mar. 27, 2009

(86) PCT No.: PCT/EP2009/002279

§ 371 (c)(1),
(2), (4) Date: Oct. 4, 2010

(87) PCT Pub. No.: WO2009/124667

PCT Pub. Date: Oct. 15, 2009

(65) Prior Publication Data

US 2011/0031146 A1 Feb. 10, 2011

(30) Foreign Application Priority Data

Apr. 8, 2008 (BE) ..... 2008-0215

(51) Int. Cl.
*B65H 57/18* (2006.01)

(52) U.S. Cl.
USPC ..... 242/566; 242/615.3; 242/157 R

(58) Field of Classification Search
CPC ..... B65H 51/20
USPC ..... 242/152.1, 419, 419.4, 419.5, 566, 242/615, 615.1, 615.3, 157 R
See application file for complete search history.

(56) References Cited

U.S. PATENT DOCUMENTS 3,345,702 A 10/1967 Miedler

*Primary Examiner* — William E Dondero
(74) *Attorney, Agent, or Firm* — Symbus Law Group, LLC; Clifford D. Hyra

(57) ABSTRACT

A yarn storage device provided for supplying yarns to a yarn processing device has a number of yarn storage tubes (1) which are each provided with an input side (2) along which the yarn is supplied to the yarn store (4) and an output side (3) along which the yarn is delivered from the yarn store (4) to the yarn processing device. The yarn storage device also has a yarn loader which is provided for introducing the yarn into the respective yarn storage tube (1) in the form of successive windings which form the yarn store. A yarn is guided in a yarn storage tube of a yarn storage device of this type.

17 Claims, 2 Drawing Sheets

YARN STORAGE DEVICE

This application claims the benefit of Belgian patent application No. 2008/0215, filed Apr. 8, 2008, which is hereby incorporated by reference in its entirety.

BACKGROUND

In the multicoloured weaving and tufting of carpet, the various pile-warp yarns are often supplied from a bobbin creel to a device which, in accordance with the desired pattern, selects the pile-warp yarns or brings them into a position in which they produce the desired effect in the fabric.

Bobbin creels of this type can be very awkward both in terms of the area which they take up and in terms of the quantity and value of the yarn which they have in stock for carrying out the process.

A solution to limit both the necessary space and the amount of yarn in a yarn processing installation is described in EP 422 093. EP 422 093 describes a yarn storage system comprising a multiplicity of yarn buffer units arranged next to one another in the form of elongate tubes inside which yarn is stored. Each tube has an open entry side along which the yarn is supplied to the yarn store and an open output side through which the yarn is delivered from the store in the tube to the yarn processing device. In order to allow continuity in production by the yarn processing device, even during replenishing of the yarn stores, a yarn loader moves on the input side of the tubes, from tube to tube, to replenish the store of yarn in the tubes with the desired yarn for the continuation of the yarn processing process.

The replenishing takes place by connecting the newly supplied yarn to the most recently introduced part of the yarn in the yarn store in the tube, followed by supplying the new yarn by rotating the head of the yarn loader, thus laying in the tube successive windings which, in accordance with the activation of the yarn loader, can assume any desired shape: windings having a constant diameter, windings having a variable diameter, planetary windings, figures of 8, etc. The yarn loader can in this case be provided with a pressure disc which presses against the remaining store in order to attach the windings as uniformly as possible, to keep them compact and to prevent the windings from falling or becoming entangled. The newly laid windings push the yarn store further into the yarn storage tube. For the first filling of the yarn storage device, EP 422 093 provides a counter-disc to keep the first windings straight when no preceding yarn store is yet present against which to place the windings. Once the filling of the yarn storage tube has started up properly, this counter-disc is removed via the output side in order to make possible a supply of the yarn to the yarn processing device. From that moment, the only support to keep the windings straight is the friction between the windings and the tube wall.

At the output side, the yarn is extracted to supply it to the yarn processing device with the aim of removing each winding, one by one, from the yarn store.

However, this method gives rise to problems when windings fall into the yarn store and on drawing of the yarn from the output side several of the windings become entangled. The supply of entangled windings of this type to the yarn processing installation is disruptive and leads to yarn breakage and/or shutdown of the yarn processing installation. EP 0 422 093 offers no solution to this problem.

U.S. patent publication U.S. Pat. No. 3,345,702 describes a yarn storage system comprising a tube which serves as a buffer between two yarn processing machines. On one side of the tube, the yarns are supplied to provide a buffer and on the other side of the tube the yarns are delivered to the subsequent yarn processing machine. The yarn is placed in the yarn store as windings as a result of a movement of relative rotation between the tube and the supply.

In view of the fact that windings which have fallen over can cause entangling and as a result yarn breakage or machine shutdowns, U.S. Pat. No. 3,345,702 provides, as a solution for avoiding falling of the windings, a weight in the form of a ring or a disc which is introduced on the yarn delivery side and which presses on the winding diameter against the windings and wherein the yarn of the windings located closest to this ring or disc is drawn through an opening in the ring or disc in order to be supplied to the following yarn processing machine. In order to exert a press-on force on the windings, either the yarn storage tube is arranged obliquely, as a result of which a component of the weight of the ring or disc occurs as a press-on force, or a spring is placed between the tube end on the delivery side and the ring or disc, or both are used at the same time.

However, this device displays the following drawbacks:

- in the case of a large yarn store (for example if the supply tube is filled over a long length), the risk increases that even on the input side windings will fall or assume a smaller diameter, as a result of which these windings will no longer be pressed on by the disc or ring if said disc or ring is located on the delivery side;
- by drawing the yarns on the delivery side through an opening, windings which fall and fall over one another will become entangled more easily and cause yarn breakage, machine shutdowns or damage to the yarn storage system; this can be limited by making said opening larger, but has at the same time the consequence that more small or fallen-down windings extend through the opening.

This risk increases when the hairiness of the yarns is greater, such as is for example the case with yarns used in Axminster weaving machines or tufting machines. A device of this type provides an inadequate solution to avoiding the falling-over and the entangling of yarn windings in a yarn storage system with successive yarn windings and still causes too much yarn breakage and too many machine shutdowns of the yarn processing machines.

SUMMARY

This invention relates firstly to a yarn storage device provided for supplying yarns to a yarn processing device comprising a number of yarn storage tubes which are each provided with an input side along which the yarn is supplied to the yarn store and an output side along which the yarn is delivered from the yarn store to the yarn processing device, wherein the yarn storage device further comprises a yarn loader which is provided for introducing the yarn into the respective yarn storage tube in the form of successive windings which form the yarn store. Secondly, this invention relates to a method for guiding a yarn in a yarn storage tube of a yarn storage device of this type.

The object of this invention is to provide a method and device which offer a solution to limiting or to eliminating the drawbacks of fallen-over windings and the entangling of yarn windings in a yarn storage system wherein the yarns are taken in in accordance with successive yarn windings.

The object of the invention is achieved by providing a yarn storage device provided for supplying yarns to a yarn processing device comprising a number of yarn storage tubes which are each provided with an input side along which the yarn is supplied to the yarn store and an output side along which the yarn is delivered from the yarn store to the yarn processing device, wherein the yarn storage device further comprises a yarn loader which is provided for introducing the yarn into the respective yarn storage tube in the form of successive windings which form the yarn store. This invention is characterized in that at least one yarn storage tube is arranged at an inclination so that the output side is arranged higher than the input side and in that in this tube, between the yarn store and the output side, a slidable element is arranged which is provided to guide the yarn via its external circumference in the direction of the output side. By having the yarn move via the external circumference of the slidable element, the yarn windings obtain, compared to the disclosure U.S. Pat. No. 3,345,702, more space in which to move and freedom of movement to unwind. As a result of the oblique arrangement of the yarn storage tube, the slidable element exerts, with the force component of its weight, a compressive force on the yarn store, as a result of which the yarn store is compacted and a certain tension is applied to the yarn in order to release it from the yarn store.

In a preferred embodiment of the yarn storage device according to the invention, the slidable element displays, from its largest cross section along the axis of the yarn storage tube in the direction toward the input side, a decreasing cross section, causing the element to move through a number of windings of the yarn store. This offers the advantage that the windings located on this decreasing cross section can no longer fall over.

In a more preferred embodiment of the yarn storage device, the slidable element has a maximum diameter which is between 90 and 99% of the diameter of the inscribed circle of the cross section of the yarn storage tube. This will form a clearance between the slidable element and the yarn storage tube. This clearance allows any windings which have fallen over and have not been taken up by the slidable element to move through this opening between the yarn storage tube and slidable element in order to be unwound in this horizontal state downstream of the slidable element without new windings passing over the slidable element. In particular as a result of the compressive force which the slidable element exerts on the remaining windings, an increased force is necessary in order to draw new windings over the slidable element and the difference in force compared to the situation where no slidable element is used can be sufficient to draw loose and untangle the windings in front of the slidable element, whereas this force can for example be insufficient if no slidable element is used.

According to a particular embodiment of the yarn storage device in accordance with this invention, the side of the slidable element directed toward the input side has a profile having over its entire course a curvature, the centre point of which lies within the slidable element. This type of profile has transitions which allow the windings to move easily around the slidable element. More particularly, the side of the slidable element directed toward the output side has a profile having over its entire course a curvature, the centre point of which lies within the slidable element. This form offers the advantage that the yarns, on leaving the slidable element, are entrained along a well-guided path to the output side of the yarn storage tube.

In an advantageous embodiment of the yarn storage device according to this invention, the slidable element is solid. As a result, the slidable element will have a greater weight and thus be able to exert a greater force on for example the yarn store, as a result of which an increased force is necessary to draw new windings over the slidable element so that the force required to draw loose windings, which have fallen down and move upstream of the slidable element, increases and the risk that windings which have fallen over continue to outside the delivery side is limited.

In a more advantageous embodiment of the yarn storage device, the yarn storage tube is square, hexagonal or octagonal. This offers the advantage of producing larger spaces in the corners of the tube to allow through any yarn windings which have fallen over. In particular, the yarn storage tube is arranged in such a way that one of its angular points is lower than the other angular points. As a result, the largest opening will occur at the position where any yarn windings which have fallen over are most likely to be located, i.e. at the bottom of the yarn storage tube.

In a most particular embodiment of the yarn storage device, the slidable element has a spherical shape. This offers the advantage that the slidable element can move very flexibly and the slidable element in fact performs a rolling movement over its route in the yarn storage tube; this limits blocking or jamming of the slidable element. However, there is a risk that the windings which are located on the slidable element will, as a result of the rolling, also be rotated and be led to the space behind the element. In order to avoid this, a second element is provided, in a first preferred embodiment of the yarn storage device, between the slidable element and the yarn store, wherein the second element has a cylindrical part, having a cross section which is between 90 and 99% of the diameter of the inscribed circle of the cross section of the yarn storage tube, and comprises a cross section which tapers in the direction of the input side. The presence of a second element of this type will prevent windings from rotating along with the slidable element.

In a more preferred embodiment of the yarn storage device according to this invention, the side of the second element directed toward the slidable element has a profile having over its entire course a curvature, the centre point of which lies within the second element. Most particularly, the side of the second element directed toward the slidable element is spherical.

In accordance with a particular embodiment of the yarn storage device according to this invention, the second element is hollow.

In the case of a most particular embodiment of the yarn storage device according to this invention, the outer surface of the slidable element and/or the second element comprises at least a number of grooves which are provided to guide the yarn.

According to a second preferred embodiment of the yarn storage device, a second disc-shaped element is provided between the slidable element and the yarn store, this element comprising a central opening through which the yarn of the yarn store can be moved and the second disc-shaped element is further provided with a spacing portion which extends in the direction of the slidable element.

Another subject-matter of this patent application relates to a method for guiding a yarn in a yarn storage tube of a yarn storage device, wherein the yarn storage tube comprises an input side along which the yarn is supplied to the yarn store and an output side along which the yarn is delivered from the yarn store to the yarn processing device, wherein the yarn storage device further comprises a yarn loader which is provided for introducing the yarn into the respective yarn storage tube in the form of successive windings which form the yarn store. In accordance with this invention, the yarn is guided in the direction of the output side via the external circumference of a slidable element arranged in the tube, between the yarn store and the output side.

According to a particular method in accordance with the invention, the slidable element displays, from its largest cross section along the axis of the yarn storage tube in the direction toward the input side, a decreasing cross section, causing the element to move through a number of windings of the yarn store so that the yarn winding unwinds around the part having a decreasing cross section and is further guided over the largest cross section in the direction of the output side.

The method according to this invention is applied more particularly to a yarn storage device as described hereinbefore.

BRIEF DESCRIPTION OF THE DRAWINGS

In this description, reference numerals are used to refer to the appended figures, wherein.

Figure 1:
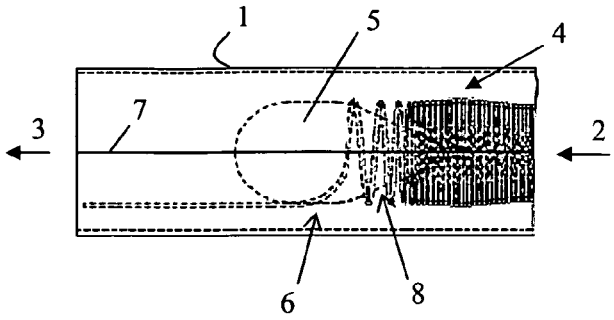
FIG. 1 presents a yarn storage tube with a first embodiment of a slidable element according to the invention.

(It should be noted that in FIGS. 1, 3, 5, 6 and 7 the yarn storage tubes are presented horizontally but in the device descend obliquely with an output side (3) lying higher than the input side (2).)

DETAILED DESCRIPTION

The features, advantages and particularities of this invention will be illustrated further in the subsequent, more detailed description of a possible embodiment thereof. The sole purpose of this description is to illustrate the invention based on an example, so that it may in no sense be regarded as a limitation of the scope of this patent application.

This invention relates to a yarn storage device provided for supplying yarns to a yarn processing device comprising a number of yarn storage tubes (1) which are each provided with an input side (2) along which the yarn is supplied to the yarn store and an output side (3) through which the yarn is delivered from the yarn store to the yarn processing device, wherein the yarn storage device further comprises a yarn loader which is provided for introducing the yarn into the respective yarn storage tube (1) in the form of successive windings (4) which form the yarn store. This invention is characterized in that at least one yarn storage tube (1) is arranged at an inclination so that the output side (3) is arranged higher than the input side (2) and in that in this tube (1), between the yarn store and the output side (3), a slidable element (5) is arranged which is provided to guide the yarn via its external circumference in the direction of the output side (3). A slidable element (5) of this type provided in a yarn storage tube (1) is illustrated inter alia in FIG. 1. The inclination of the yarn storage tubes (1) is preferably between 5 and 10° (angle between the axis of the yarn storage tube and the horizontal axis).

The slidable element (5) displays, from its largest cross section (6) along the axis (7) of the yarn storage tube (1) in the direction toward the input side (2), a decreasing cross section. As a result, the slidable element (5) comprises, as it were, a top part (8) which allows a number of windings (4) (which have not fallen over) to be taken up, wherein the yarn which is removed from the yarn store unwinds around this top (8) and moves over the largest cross section (6) to find, in the remaining portion of the yarn storage tube (1) between the yarn store and the yarn processing device, its path to the yarn processing device.

The slidable element (5) has the following effect:

- the windings (4) which are set over the top (8)—which extends toward the yarn store—can no longer fall over;
- the windings (4) move over and around the element (5) in order to move to the output side (3); this means that the windings (4) unwind toward the edges of the tube (1) instead of toward a central opening in the centre of the tube as described in U.S. Pat. No. 3,345,702. In view of the fact that the circumference of the tube (1) is larger than the space in the centre, the yarn windings (4) have space in which to move and freedom of movement to unwind.

As a result of the oblique arrangement of the yarn storage tubes (1), the slidable element (5), which is provided in the tube, exerts a compressive force on the yarn store, as a result of which on the one hand the yarn store is compacted, which allows more yarn to be taken up over the same length of the tube. On the other hand, a certain tension is exerted on the yarn windings which has to be overcome in order to release them from the yarn store. This latter phenomenon offers the advantage that should windings (4) after all fall, before they move over the top (8) of the slidable element (5) to the output side and these windings (4*a*) are drawn through around the element (5), these windings (4*a*) are located, as presented in FIG. 3, between the element (5) and the output side (3) of the yarn storage tube (1), where these fallen yarn windings (4*a*) can be drawn loose from one another without new windings (4) coming through, provided that the force with which the yarn processing device draws on the yarn in the yarn storage tube remains below the force exerted by the weight component of the slidable element (5) on the yarn windings (4) of the yarn store.

The drawing-loose of windings (4) which have fallen over requires a certain force owing to the entangling as a consequence of the hairiness of the yarns. Without the element (5), the force required to release the yarns from fallen windings can be greater than the force to remove new windings from the store. In this case, the fallen windings would move in a package to the yarn processing device, with all the disadvantageous consequences thereof: blockage in the further guide elements, yarn breakage and machine shutdowns. The presence of the slidable element (5) increases the force which can be exerted on the fallen windings (4*a*) before new windings (4) come away from the yarn store. This significantly reduces the risk of fallen windings (4*a*) moving past the output side (3).

As a result of the introduction of the slidable element (5), a large force range is reserved to unwind fallen windings before new windings (and new fallen windings) come through. With respect to the embodiment described in U.S. Pat. No. 3,345,702 without a counter-element, this means that in the device according to the invention significantly fewer fallen windings (4*a*) pass through in non-unwound form to the yarn processing device, as a result of which much less yarn breakage and many fewer machine shutdowns occur. Furthermore, the use of a counter-disc or counter-ring (cf. U.S. Pat. No. 3,345,702)

has, as mentioned hereinbefore, the drawback that fallen-over windings become jammed before the central opening and as early as this stage cause yarn breakage and machine shut-downs.

If the slidable element (5) has at its largest cross section (6) a diameter of between 90 and 99% of the diameter of the largest inscribed circle in the tube (1) and in view of the fact that the yarn is guided via the external circumference of the element (5), this means that the yarn should move through the clearance between the element (5) and the tube (1). This clearance also allows windings (4*a*) which have fallen over and have not been taken up by the top (8) to move through this opening between the yarn storage tube (1) and element (5) in order to be unwound in this horizontal state downstream of the element (5) without new windings (4) passing over the element (5).

Figure 2:
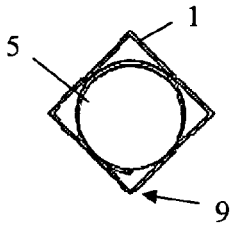
FIG. 2 is a cross section of a yarn storage tube lying with one of its corners lower than the other corners.

The yarn storage tube (1) can assume various shapes such as for example round, square, hexagonal or octagonal. However, if the tube (1) is square, hexagonal or octagonal in shape, a larger space will be available at the level of the angular points to allow through any fallen yarn windings (4*a*). If a yarn storage tube of this type is arranged in such a way that one of its angular points is, as for example presented in FIG. 2, lower than the other angular points, this means that the largest opening occurs at the most likely position of windings which have fallen over, i.e. at the bottom. This means an additional advantage for guiding the yarn easily to the output side (3). This is the most likely position, in view of the fact that the yarns usually fall from the yarn storage tube (1) once they leave these moving downward and are drawn in this direction and also because fallen windings usually fall downward and thus leave the yarn storage tube at the bottom.

Such an arrangement of the yarn storage tube also offers the advantage that during refilling of the yarn storage tube, wherein the slidable element moves more rapidly to the output side under the influence of the yarn windings fed by the yarn loader, then the yarn processing device uses up the yarn for the slidable element, this yarn for the slidable element falls downward and is located freely in the opening under the slidable element (5) and under the yarn windings (4) in the yarn store between the slidable element (5) and the input side (2).

If the top shape (8) of the element (5) toward the yarn store side and the input side is spherical, it has a shape which guides the unwound yarn windings in a simple and flowing manner over the slidable element (5). If the top shape of the slidable element (5) directed toward the exit side (3) is also spherical, the yarns are accompanied, on leaving the element (5), along a well-guided route to the output side (3).

Figure 3:
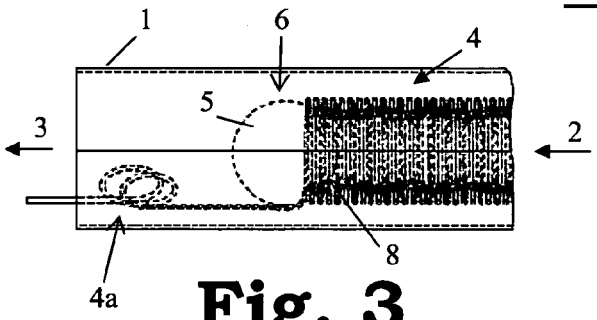
FIG. 3 presents a yarn storage tube with a spherical slidable element according to the invention, wherein windings which have fallen down are located between the slidable element and the output side.

If the slidable element (5) is, as presented in FIG. 3, completely spherical, this provides an element (5) which can move so as to roll in a very flexible manner over its route in the yarn storage tube (1), and no longer necessarily in a sliding manner. In this embodiment a minimal top shape does indeed remain which allows a number of windings (4) to be taken up centrally.

In addition to the advantages of a spherical shape of this type, drawbacks include the fact that, as a result of the rolling, the windings (4) on the spherical top (8) can, should said windings not slide sufficiently on the spherical top, be jointly rotated and be led to the space behind the element (5).

Figure 4:
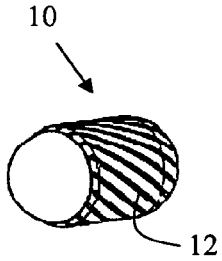
FIG. 4 presents a first embodiment of the second element with grooves on its circumference.
Figure 5:
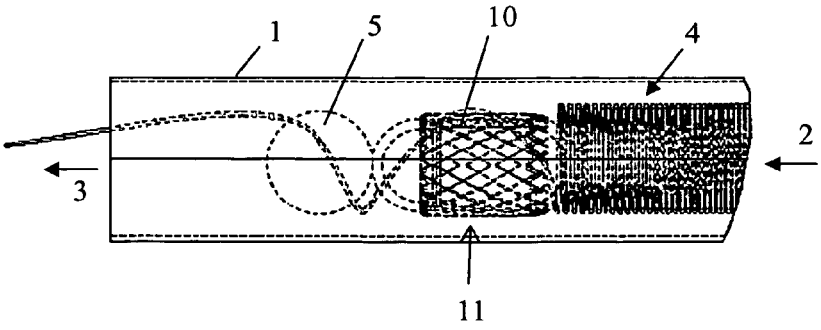
FIG. 5 presents a yarn storage tube with a spherical slidable element and a second hollow element with grooves on its circumference.

In order to avoid this, a second element (10) (see FIG. 4) can be provided, as presented in FIG. 5, between the slidable element (5) and the yarn store, wherein the second element has a cylindrical part (11) having a cross section which is between 90 and 99% of the diameter of the inscribed circle of the cross section of the yarn storage tube (1) and further comprises a cross section which tapers in the direction of the input side (2). This second element (10) is in contact, preferably via point contact, with the slidable element (5) and will move, as a result of its cylindrical part (11), only along the axis of the yarn storage tube (translation and rotation). The adjacent slidable element (5) will furthermore be able to move so as to roll freely if it has a spherical shape. The second element (10) is preferably hollow and has more particularly a low weight, allowing it to slide smoothly in the yarn storage tube (1). The force on the yarn is now transmitted, through the weight of the spherical slidable element (5), to the second element (10) which exerts the force on the windings (4). Windings which have fallen over will in this way, as described hereinbefore, move along the second element (10) and along the slidable element (5).

If the second element (10) is provided with grooves (12), in particular spiral-shaped grooves, this produces an additional effect that the yarn which is released is placed, in its path to the output side (3), in the groove (12) and the second element (10) produces rotation about its axis so that, if the groove course is selected appropriately, the groove opening on the yarn store side moves in conjunction with the point, where the yarn enters into contact with the second element which point shifts in accordance with the yarn winding.

Figure 6:
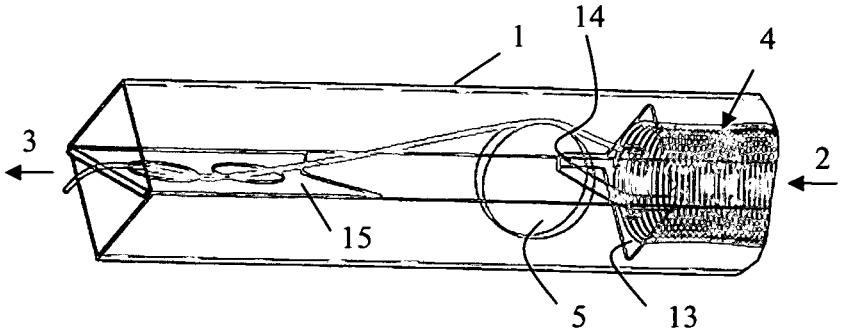
FIG. 6 is a perspective view of a yarn storage tube with a second embodiment of the second element, wherein this second element is disc-shaped and is provided with a spacer.
Figure 7:
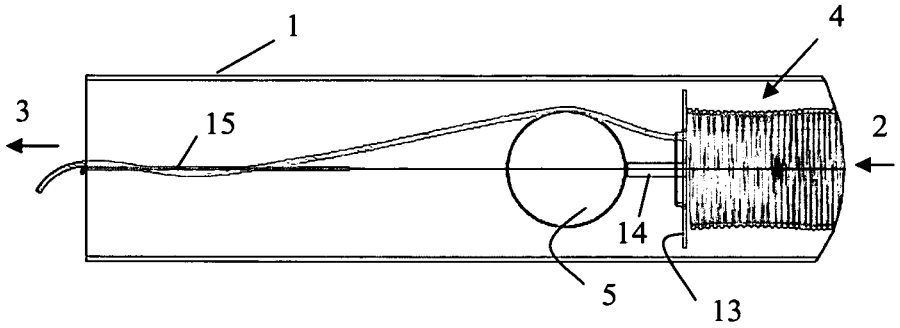
FIG. 7 is a side view of a device according to FIG. 6.

FIGS. 6 and 7 present another preferred device wherein a second element (13) is provided between the yarn store (4) and the slidable element (5), which displays on the side of the yarn store (4) a disc shape having a shape corresponding substantially to the internal shape of the yarn storage tube (with a slight clearance), which presses on the outside of the yarn windings (4) and displays a central opening through which the yarn of the yarn store (4) follows its path toward the output side (3) and which is further provided with a spacing portion (14) which extends in the direction of the slidable element (5). The spacing portion comprises preferably at least two arms which are arranged spread over the circumference of the disc-shaped second element (13). The arms are joined together in such a way that the overall unit, formed by the at least two arms with their connection, extends through the centre of the yarn storage tube.

In this way, the yarn of the yarn windings in the yarn store is drawn first through the centre of a pressure disc (cf. U.S. Pat. No. 3,345,702), as a result of which windings which move through the opening of the pressure ring can still be released during their movement over the slidable element or past the slidable element (5). In order to limit the risk of blocking the central opening in the pressure disc as in U.S. Pat. No. 3,345,702, this opening can be selected so as to be larger in this embodiment. After all, after this pressure ring, there is still the slidable element (5) to fulfil the function of releasing the extra windings which have fallen down before new windings move around the slidable element to the output side (3).

FIGS. 6 and 7 also show, still at the front of the yarn storage tube (1), an element (15) which also displays an extra means for unravelling windings (4*a*) which have fallen over and for reducing the risk of disruptions or yarn breakage: a plate-shaped element (15) which lies (apart from the inclination of the yarn storage tube) substantially horizontally along the axis of the yarn storage tube. This plate-shaped element (15) has two openings lying one after the other in the longitudinal direction of the yarn storage tube. The yarn issues from the yarn store, for example above the spacer as the second element, extends around the sliding element (5) and moves further above the plate-shaped element (15), where it moves through the first opening to the underside of the plate-shaped element (15) in order subsequently to issue through the second opening back above the plate-shaped element (15). This obstacle further increases the chance to unravel fallen windings which have not yet unravelled before they are supplied to the yarn processing device.

The yarn processing device is preferably an Axminster weaving machine, a double-face weaving machine, a tufting machine or a knitting machine.

The invention claimed is:

1. Yarn storage device provided for supplying yarns to a yarn processing device comprising a number of yarn storage tubes which are each provided with an input side along which the yarn is supplied to a yarn store and an output side along which the yarn is delivered from the yarn store to the yarn processing device, wherein the yarn storage device further comprises a yarn loader which is provided for introducing the yarn into the respective yarn storage tube in the form of successive windings which form the yarn store, wherein at least one yarn storage tube is arranged at an inclination so that the output side is arranged higher than the input side and in that in this tube, between the yarn store and the output side, a slidable element is arranged which is provided to guide the yarn via the slidable element's external circumference in the direction of the output side.

2. Yarn storage device according to claim 1, wherein the slidable element displays, from the slidable element's largest cross section along the axis of the yarn storage tube in the direction toward the input side, a decreasing cross section, causing the element to move through a number of windings of the yarn store.

3. Yarn storage device according to claim 1, wherein the slidable element has a maximum diameter which is between 90 and 99% of the diameter of the inscribed circle of the cross section of the yarn storage tube.

4. Yarn storage device according to claim 1, wherein the side of the slidable element directed toward the input side has a profile having over the slidable element's entire course a curvature, the centre point of which lies within the slidable element.

5. Yarn storage device according to claim 1, wherein the side of the slidable element directed toward the output side has a profile having over the slidable element's entire course a curvature, the centre point of which lies within the slidable element.

6. Yarn storage device according to claim 1, wherein the slidable element has a spherical shape.

7. Yarn storage device according to claim 1, wherein the slidable element is solid.

8. Yarn storage device according to claim 1, wherein the yarn storage tube is square, hexagonal or octagonal.

9. Yarn storage device according to claim 8, wherein the yarn storage tube is arranged in such a way that one of the yarn storage tube's angular points is lower than the other angular points.

10. Yarn storage device according to claim 1, wherein a second element is provided between the slidable element and the yarn store, wherein the second element has a cylindrical part, having a cross section which is between 90 and 99% of the diameter of the inscribed circle of the cross section of the yarn storage tube, and comprises a cross section which tapers in the direction of the input side.

11. Yarn storage device according to claim 10, wherein the side of the second element directed toward the slidable element has a profile having over the second element's entire course a curvature, the centre point of which lies within the second element.

12. Yarn storage device according to claim 10, wherein the side of the second element directed toward the slidable element is spherical.

13. Yarn storage device according to claim 10, wherein the second element is hollow.

14. Yarn storage device according to claim 10, wherein the outer surface of the slidable element or the second element comprises at least a number of grooves which are provided to guide the yarn.

15. Yarn storage device according to claim 1, wherein a second disc-shaped element is provided between the slidable element and the yarn store, this second disc-shaped element comprising a central opening through which the yarn of the yarn store can be moved and in that the second disc-shaped element is further provided with a spacing portion which extends in the direction of the slidable element.

16. Method for guiding a yarn in a yarn storage tube of a yarn storage device, wherein the yarn storage tube comprises an input side along which the yarn is supplied to the yarn store and an output side through which the yarn is delivered from the yarn store to the yarn processing device, wherein the yarn storage device further comprises a yarn loader which is provided for introducing the yarn into the respective yarn storage tube in the form of successive windings which form the yarn store, wherein the yarn is guided in the direction of the output side via the external circumference of a slidable element arranged in the tube, between the yarn store and the output side.

17. Method according to claim 16, wherein the slidable element displays, from the slidable element's largest cross section along the axis of the yarn storage tube in the direction toward the input side, a decreasing cross section, causing the element to move through a number of windings of the yarn store so that the yarn winding unwinds around the part having a decreasing cross section and is further guided over the largest cross section in the direction of the output side.

* * * * *